US010633875B2

(12) United States Patent
Clevenger

(10) Patent No.: US 10,633,875 B2
(45) Date of Patent: Apr. 28, 2020

(54) CONCRETE FORMING SYSTEM AND METHOD OF ASSEMBLING

(71) Applicant: Michael Clevenger, Port Ludlow, WA (US)

(72) Inventor: Michael Clevenger, Port Ludlow, WA (US)

( * ) Notice: Subject to any disclaimer, the term of this patent is extended or adjusted under 35 U.S.C. 154(b) by 91 days.

(21) Appl. No.: 15/995,529

(22) Filed: Jun. 1, 2018

(65) Prior Publication Data

US 2018/0347213 A1 Dec. 6, 2018

Related U.S. Application Data

(60) Provisional application No. 62/514,054, filed on Jun. 2, 2017.

(51) Int. Cl.

| | |
|---|---|
| ***E04G 11/12*** | (2006.01) |
| ***E04G 17/14*** | (2006.01) |
| ***E04G 17/075*** | (2006.01) |
| ***E04G 11/06*** | (2006.01) |
| ***E04G 19/00*** | (2006.01) |
| ***E04G 17/12*** | (2006.01) |
| ***E04G 17/07*** | (2006.01) |

(52) U.S. Cl.

CPC ..... *E04G 11/12* (2013.01); *E04G 11/06* (2013.01); *E04G 17/0721* (2013.01); *E04G 17/0754* (2013.01); *E04G 17/0758* (2013.01); *E04G 17/12* (2013.01); *E04G 17/14* (2013.01); *E04G 19/003* (2013.01)

(58) Field of Classification Search

CPC ..... E04G 11/10; E04G 11/12; E04G 17/14; E04G 17/0721; E04G 17/0754; E04G 19/003

USPC ..... 249/219.1, 219.2

See application file for complete search history.

(56) References Cited

U.S. PATENT DOCUMENTS 1,291,257 A * 1/1919 Thompson ..... B25B 1/103 269/246
1,580,981 A * 4/1926 White ..... E04G 17/0642 249/219.1
1,863,177 A * 6/1932 Wilson ..... E04G 17/0754 249/190
2,107,427 A * 2/1938 Schwarzler ..... E04G 11/14 249/193
2,116,597 A * 5/1938 Colt ..... E04G 17/0658 249/217
2,236,616 A * 4/1941 Bosco ..... E04G 17/0714 249/45
2,378,850 A * 6/1945 Hyre ..... E04G 17/064 249/210
2,511,584 A * 6/1950 Hill ..... E04G 11/10 249/27
2,535,277 A * 12/1950 Augustine ..... E04G 11/10 249/34
2,554,430 A * 5/1951 Vines ..... E04G 17/0721 269/37
2,572,366 A * 10/1951 Jack ..... E04G 17/001 269/165
2,581,403 A * 1/1952 Gabrielson ..... E04G 17/12 269/45

(Continued)

*Primary Examiner* — Michael Safavi
(74) *Attorney, Agent, or Firm* — Eckert Seamans Cherin & Mellott, LLC; Brij K. Agarwal

(57) ABSTRACT

A concrete form assembly that includes a shaping assembly with a number of generally planar panels, and, a retaining assembly with a number of whaler clamp assemblies and a number of whaler cleat assemblies.

15 Claims, 8 Drawing Sheets

(56) References Cited

U.S. PATENT DOCUMENTS 2,727,294 A * 12/1955 Artil ..... E04G 17/12 249/47
2,732,606 A * 1/1956 Wheeler ..... E04G 17/0658 249/215
2,973,567 A * 3/1961 Brow, Jr. ..... E04G 17/12 249/207
3,327,986 A * 6/1967 Oury ..... E04G 17/07 249/45
3,374,984 A * 3/1968 Mueller ..... E04G 17/12 249/216
3,404,862 A * 10/1968 Roy ..... E04G 17/001 249/219.2
3,462,108 A * 8/1969 Buyken ..... E04G 17/02 249/219.2
3,479,000 A * 11/1969 Powell ..... E02D 5/02 249/219.1
3,722,849 A * 3/1973 Luyben ..... E04G 13/00 249/219.1
3,729,159 A * 4/1973 Foster ..... E04G 17/02 249/219.2
3,762,679 A * 10/1973 Black ..... E04G 17/001 249/194
3,771,757 A * 11/1973 Black ..... E04G 17/001 249/219.2
4,079,910 A * 3/1978 Miller ..... E04G 17/0742 249/216
4,426,061 A * 1/1984 Taggart ..... E04B 2/8605 249/191
4,646,496 A * 3/1987 Wilnau ..... E04B 1/163 249/219.2
4,726,560 A 2/1988 Dotson
5,016,855 A * 5/1991 Huggins ..... E04G 13/04 249/20
5,110,083 A * 5/1992 Page ..... E04G 17/00 182/82
5,861,105 A * 1/1999 Martineau ..... E04B 2/8652 249/190
6,024,339 A * 2/2000 Gates ..... E04G 11/14 249/191
6,237,890 B1 * 5/2001 Gates ..... E04G 11/12 249/219.1
6,254,056 B1 * 7/2001 Alfred ..... E04G 17/0707 249/219.1
7,494,106 B2 * 2/2009 Mathis ..... E04G 11/065 249/192
7,775,500 B1 * 8/2010 Vegsund ..... E04G 11/12 249/219.2
2010/0176525 A1 * 7/2010 Krayenhoff ..... E04B 2/84 264/35
2016/0281376 A1 * 9/2016 Ward ..... E04G 17/04

* cited by examiner

CONCRETE FORMING SYSTEM AND METHOD OF ASSEMBLING

CROSS REFERENCE TO RELATED APPLICATION

This application claims the benefit of U.S. Patent Application Ser. No. 62/514,054, filed Jun. 2, 2017, which is incorporated by reference herein

BACKGROUND OF THE INVENTION

Field of the Invention

The disclosed and claimed invention relates to a concrete forming system and, more particularly, to a concrete forming system wherein assembling a shaping assembly and a retaining assembly takes a reduced amount of time.

Background Information

A concrete wall is created using a forming system. As used herein, a "forming system" includes a "shaping assembly" and a "retaining assembly." As used herein, a "shaping assembly" includes the elements of the forming system that contact the outer surface(s), i.e., the outer surfaces of the resultant wall, of the wet concrete after it is poured. As used herein, the "retaining assembly" includes the structural elements, such as, but not limited to, braces and supports that maintain the shaping assembly in the desired shape. For most walls, the shaping assembly includes a number of rectangular panels that are disposed in a generally parallel spaced relation. The retaining assembly includes elements such as, but not limited to, metal snap-ties, brackets and/or cleats and wood studs (vertical beams) and whalers (horizontal beams).

Generally, when creating a concrete wall, a footer, or foundation is poured and set. The forming system is then assembled above the footer. Assembling a traditional forming assembly includes positioning cleats on the footer. A cleat includes two upwardly facing brackets sized to support shaping assembly panels in a spaced relation. When the wall is longer than a panel, the cleats are set at each seam between adjacent panels and about every 12 inches to 16 inches apart. The panels are typically wood such as, but not limited to, plywood. The panels are also spaced by "snap-ties." A snap-tie, as used herein, includes an elongated rod with a brace at each end. The snap-ties are disposed in a grid-like pattern between the panels. Thus, before the panels are installed on the cleats, a grid-like pattern is drilled into opposing panels. The panels are then installed followed by the snap-ties.

For taller walls, whalers are also attached to the panels. The whalers are commonly braced by wood members extending to the ground. Often, the whalers are nailed to the panels. In other instances, the snap-ties extend through the whalers. Depending upon the height of the wall to be formed, there may be more than one generally horizontal whaler. Such whalers are vertically spaced. Finally, cleats are also attached to the upper edge of the panels. The cleats and the snap-ties, as well as the whalers if installed, ensure that the panels remain spaced apart while also generally ensuring the panels do not bulge or otherwise deform due to the weight of the concrete.

With the forming system in place, concrete is poured between the panels. The upper surface of the wet concrete is smoothed, i.e., by troweling. The space between the upper cleats is easily accessed by a trowel. To smooth the area underneath the upper cleats, the upper cleats are removed one at a time, the concrete is troweled, and the upper cleat is reinstalled. This process, however, may allow the panels to bulge and may result in the concrete setting with the bulge. This is a problem.

Further, as described above, much of the wood elements of the forming system are consumed. That is, the wood elements are adapted for a specific installation and cannot be used again. This is a problem as the consumable materials are expensive. Further, certain elements of the forming system are made from reusable materials, such as, but not limited to, reusable plastic or poly panels. Such panels are not, however, favored as pre-made passages for snap ties or couplings for whalers may not be in a desired location. The use of consumable elements is a problem. That is, elements that are used once, or a limited number of times, is a problem.

Further, some walls include reinforcing bar, hereinafter "rebar." As is known, rebar may be individual rods or a grid-like pattern of wires. The rebar is positioned generally centrally in the wall. Thus, to position the rebar prior to the concrete pour, workers often drill holes in the panels adjacent the rebar, run a string through the holes, couple the string to the rebar, and pull the string taught. The string may be coupled, or wrapped around a nail or similar object. By winding or unwinding the string from the nail, the position of the rebar is adjusted. This is a time consuming process and is a problem.

Further, the process of assembling the forming system as described above is time consuming and takes an "excessive" amount of time. That is, as used herein, a method of assembling a forming system that includes drilling holes for snap-ties, building braces for whalers at the pour site, or requires the removal and replacement of upper cleats for smoothing the upper surface of the poured concrete wall, take an "excessive" amount of time. Further, as used herein, a method of assembling a forming system that includes drilling holes for snap-ties, building braces for whalers at the pour site, and requires the removal and replacement of upper cleats for smoothing the upper surface of the poured concrete wall, take a "very excessive" amount of time. This is also a problem.

There is, therefore, a need for a forming system that does not use, or primarily use, consumable elements. There is a further need for a forming system that can be assembled in less than an excessive amount of time.

SUMMARY OF THE INVENTION

These needs, and others, are met by at least one embodiment of the disclosed and claimed concept which provides a concrete form assembly including a shaping assembly with a number of generally planar panels, and, a retaining assembly with a number of whaler clamp assemblies and a number of whaler cleat assemblies.

Further, a method of assembling a concrete form is provided and includes providing a shaping assembly including a number of generally planar panels, providing a retaining assembly including a number of whaler clamp assemblies, a number of whaler cleat assemblies, and a number of whalers, the number of whaler clamp assemblies includes a first whaler clamp assembly and a second whaler clamp assembly, the number of whaler cleat assemblies includes a first whaler cleat assembly and a second whaler cleat assembly, wherein each shaping assembly panel is generally rectangular having a first vertical edge, a second vertical edge, and a generally centered and generally vertical longitudinal axis. Then, assembling the shaping assembly and the retaining assembly including, disposing a first whaler cleat assembly and a second whaler cleat assembly in a spaced and aligned formation, coupling a first lower whaler to the first whaler cleat assembly and the second whaler cleat assembly, coupling a second lower whaler to the first whaler cleat assembly and the second whaler cleat assembly, coupling the first panel to the first whaler cleat assembly, coupling the second panel to the second whaler cleat assembly, coupling the third panel to the first whaler cleat assembly, coupling the fourth panel to the second whaler cleat assembly, coupling the first whaler clamp assembly to the first panel and the third panel in a clamping configuration, coupling the second whaler clamp assembly to the second panel and the fourth panel in a clamping configuration, coupling a first upper whaler to the first whaler clamp assembly and the second whaler clamp assembly, and coupling a second upper whaler to the first whaler clamp assembly and the second whaler clamp assembly. Wherein assembling the shaping assembly and a retaining assembly takes a reduced amount of time. Finally, the method includes pouring concrete between the first panel and the third panel, and, the second panel and the fourth panel.

BRIEF DESCRIPTION OF THE DRAWINGS

A full understanding of the invention can be gained from the following description of the preferred embodiments when read in conjunction with the accompanying drawings in which:

FIG. 8A is a first portion of a flowchart of the disclosed method. FIG. 8B is a second portion of a flowchart of the disclosed method.

DESCRIPTION OF THE PREFERRED EMBODIMENTS

Figure 1:
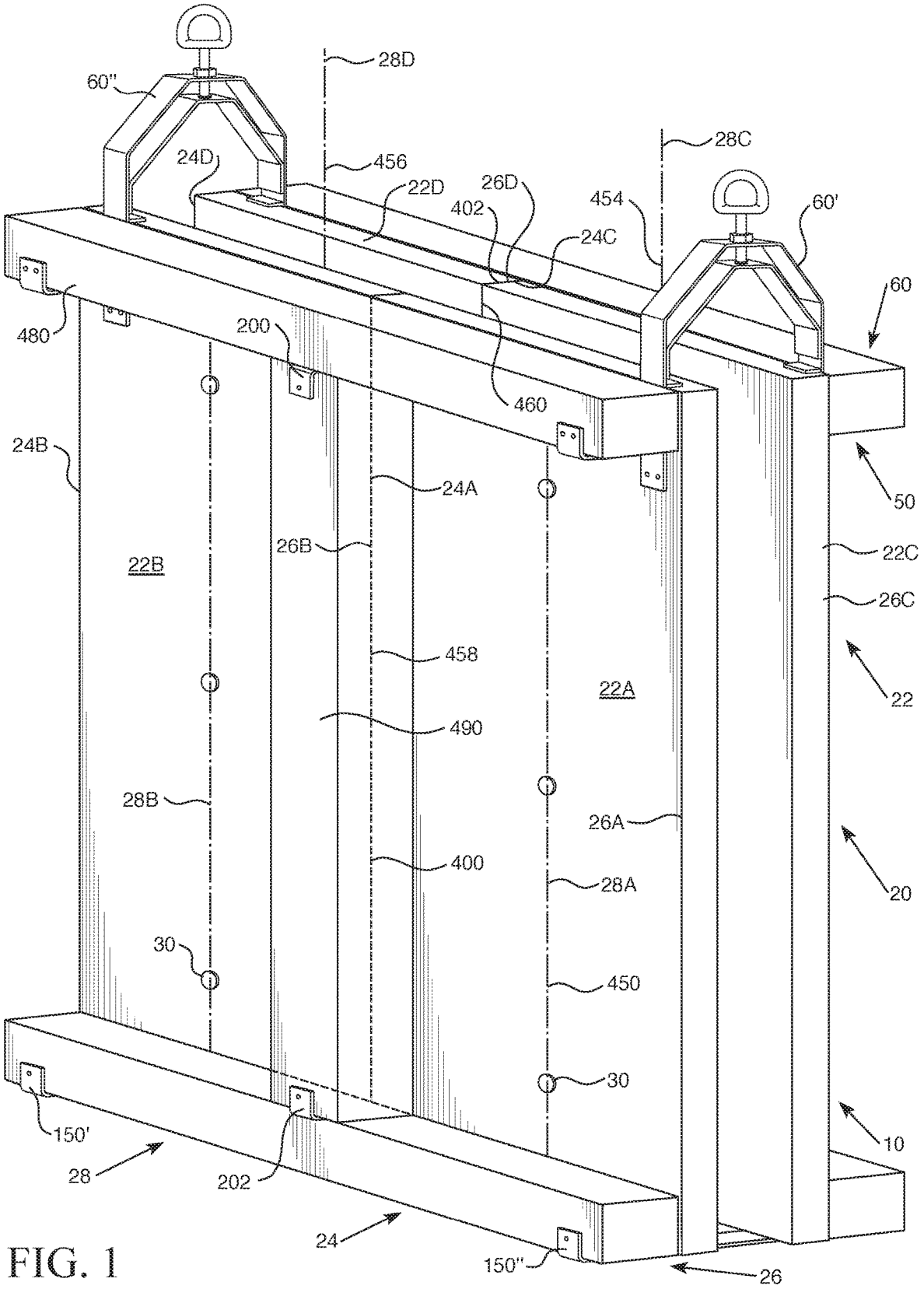
FIG. 1 is a schematic isometric view of a concrete form assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly(ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening is made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, a "path of travel" or "path," when used in association with an element that moves, includes the space an element moves through when in motion. As such, any element that moves inherently has a "path of travel" or "path."

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i e, a plurality).

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, a "clamping configuration" means a configuration of a whaler clamp assembly wherein the tines thereof are spaced a sufficient distance apart so that the forming panels coupled thereto are maintained in a substantially fixed spacing.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As used herein, "generally curvilinear" includes elements having multiple curved portions, combinations of curved portions and planar portions, and a plurality of planar portions or segments disposed at angles relative to each other thereby forming a curve.

As used herein, a "contour" means the line or surface that defines an object. That is, for example, when viewed in cross-section, the surface of a three-dimensional object is reduced to two dimensions; thus, a portion of a three-dimensional surface contour is represented by a two-dimensional line contour.

As used herein, a "perimeter portion" means the area at the outer edge of a defined area, surface, or contour.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and near relevant to the term being modified as would be understood by one of ordinary skill in the art.

As shown in FIG. 1, a concrete form assembly 10 includes a shaping assembly 20 and a retaining assembly 50. In an exemplary embodiment, the shaping assembly 20 includes a number of generally planar panels 22. As shown, the panels 22 are generally rectangular. In this configuration, each panel 22 includes a first vertical edge 24 and a second vertical edge 26. Further, as shown, the panels 22 are oriented with the longitudinal axis extending generally vertically. Thus, each panel 22 also includes a generally centered and generally vertical longitudinal axis 28.

Further, as shown as an example, there are four panels 22 disposed as opposed pairs. As used herein, constructs disposed in "opposed pairs" means that two constructs are positioned generally opposite each other so that the constructs generally mirror each other. That is, there is a first panel 22"A," a second panel 22"B," a third panel 22"C," and a fourth panel 22"D." Generally, hereinafter, elements associated with the first panel 22A shall include the letter "A," elements associated with the second panel 22B shall include the letter "B," and so forth. That is, for example, the first panel 22A includes a first vertical edge 24"A," second vertical edge 26"A," and a vertical longitudinal axis 28"A." Similarly, there are first vertical edges 24B, 24C, 24D, second vertical edges 26B, 26C, 26D, and vertical longitudinal axes 28B, 28C, 28D, for the second panel 22B, the third panel 22C, and the fourth panel 22D, respectively. As shown, the first panel 22A and the second panel 22B are disposed generally in the same plane with the first panel vertical first edge 24A disposed immediately adjacent the second panel second vertical edge 26B wherein the first panel vertical first edge 24A and the second panel second vertical edge 26B define a first snap tie line 400. Further, the third panel 22C and the fourth panel 22D disposed generally in the same plane with the third panel vertical first edge 24C disposed immediately adjacent the fourth panel second vertical edge 26D wherein the third panel vertical first edge 24C and the fourth panel second vertical edge 26D define a second snap tie line 402. As described below, the first and second panels 22A, 22B are disposed in a spaced and opposed relation to the third and fourth panels 22C, 22D. As used herein, "opposed" means spaced from and generally parallel to.

In one exemplary embodiment, the panels 22 are made from a reusable material. As used herein, a "reusable" material includes plastic or poly materials. Further, as used herein, wood is not a "reusable" material. In an exemplary embodiment, each panel 22 does not include, i.e., excludes, passages for snap-ties. In another exemplary embodiment, each panel 22 includes a number of normal pre-formed passages 30, each pre-formed passage disposed along the panel longitudinal axis 28. As used herein, a "normal" passage extends generally perpendicular to the planar surfaces of the panel 22. As discussed in detail below, the line of passages 30 is also identified herein as a "snap-tie line."

Figure 2:
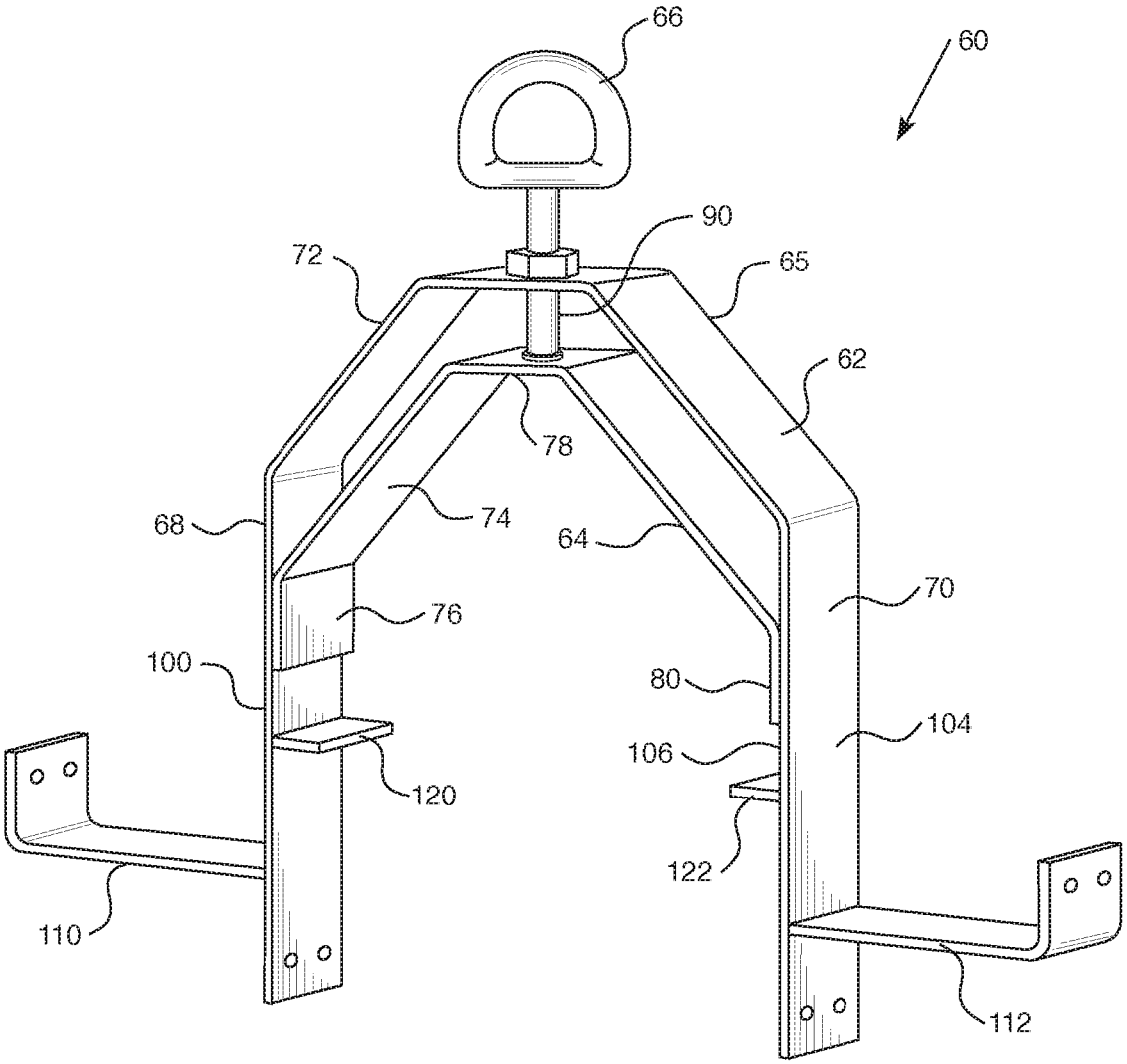
FIG. 2 is an isometric view of a whaler clamp assembly.
Figure 3:
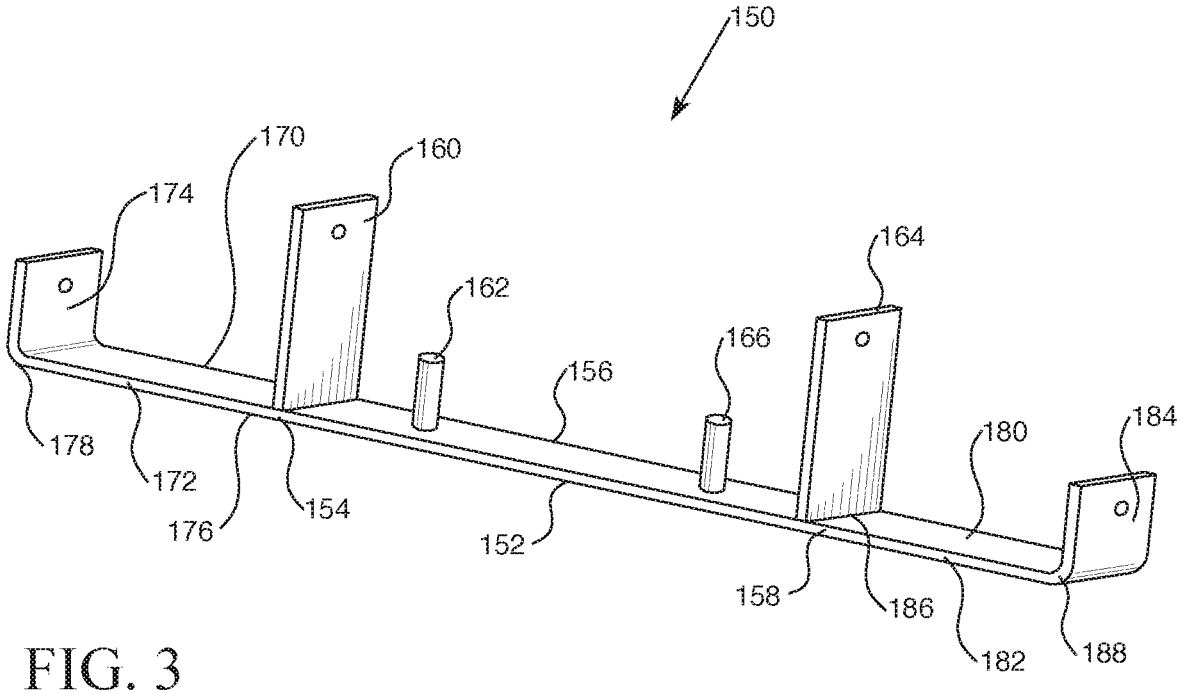
FIG. 3 is an isometric view of a whaler cleat assembly.

The retaining assembly 50 includes a number of whaler clamp assemblies 60 and a number of whaler cleat assemblies 150, as shown in FIGS. 2 and 3. As used herein, a "whaler clamp assembly" is an assembly that is structured to support a whaler and to clamp the panels 22. Each whaler clamp assembly 60 is substantially similar and only one will be described. Hereinafter, reference to a "first" whaler clamp assembly 60' will be identified with a single "prime" symbol, i.e., a "'." Further, reference to a "second" whaler clamp assembly 60 will be identified with a "double prime" symbol, i.e., " ";" and so forth. In an exemplary embodiment, a whaler clamp assembly 60 includes an inverted, unitary U-shaped member 62, alternatively, an "arched body" 62, an actuator link 64, and an actuator 66. The U-shaped member 62 includes a body 65 with a first tine 68, a second tine 70, and a bight portion 72. As used herein, a "tine" is one of a number of elongated members disposed generally parallel to each other. As used herein, a "bight" is the element that extends between two adjacent tines 68, 70. The actuator link 64 includes an elongated body 74 with a first end 76, a medial portion 78, and a second end 80. The actuator link body first end 76 is coupled, directly coupled, or fixed to the U-shaped member body first tine 68. The actuator link body second end 80 is coupled, directly coupled, or fixed to the U-shaped member body second tine 70. The actuator 66 is operatively coupled to the U-shaped member body 65 and the actuator link body 74. The actuator 66 is structured to, and does, move the U-shaped member body 65 between a first configuration, wherein the U-shaped member body first tine 68 and the U-shaped member body second tine 70 are spaced, and a second configuration wherein the U-shaped member body first tine 68 and the U-shaped member body second tine 70 are closer together. In an exemplary embodiment, the actuator 66 includes an elongated, threaded rod 90. The actuator 66 is threadably coupled to the U-shaped member body bight portion 72 and the actuator link body medial portion 78.

Each U-shaped member body first tine 68 includes an outer surface 100 and an inner surface 102. Each U-shaped member body second tine 70 includes an outer surface 104 and an inner surface 106. The U-shaped member body first tine outer surface 100 includes a first whaler bracket 110. As used herein, a "whaler bracket" is a bracket sized and shaped to support a whaler 480. In an exemplary embodiment, a whaler 480 is made from a wood 2-by-4; thus, in this embodiment, a "whaler bracket" is an upwardly facing U-shaped member sized to correspond, or snuggly correspond, to a wood 2-by-4. The U-shaped member body second tine outer surface 104 also includes a second whaler bracket 112. Further, each U-shaped member body first tine inner surface 102 includes a first support lug 120. Each lug 120, 122 is structured to, and does, rest on the upper surface of a panel 22. Further, each U-shaped member body first support lug 120 is spaced an effective distance from the associated U-shaped member body first whaler bracket 110. As used herein, an "effective distance" means a distance so that, when the whaler clamp assembly 60 is installed on a shaping assembly 20, the whaler bracket 110, 112 is disposed below the top of the shaping assembly 20. Each U-shaped member body second tine inner surface 106 includes a second support lug 122. Each U-shaped member body second support lug 122 is also spaced an effective distance from the U-shaped member body second whaler bracket 112.

In this configuration, whaler clamp assemblies 60 are structured to be, and are, coupled to the upper end of the shaping assembly 20. The support lugs 120, 122, are structured to, and do, ensure the inverted U-shaped member 62, the actuator link 64, and the actuator 66 are spaced from the upper surface of the shaping assembly 20. In this configuration, the whaler clamp assemblies 60 are not disposed adjacent to the upper surface of the poured concrete. As used herein, "adjacent to the upper surface of the poured concrete" means an element is so close to the upper surface of the poured concrete that a trowel cannot be used to smooth the upper surface of the poured concrete. Thus, because the whaler clamp assemblies 60 are not disposed adjacent to the upper surface of the poured concrete, a worker can trowel the upper surface of the poured concrete without removing elements of the concrete form assembly 10. Stated alternately, the whaler clamp assemblies 60 are structured to allow, and do allow, a worker to trowel the upper surface of the poured concrete without removing elements of the concrete form assembly 10. This solves the problems stated above.

Each whaler cleat assembly 150 is substantially similar and only one will be described. Hereinafter, first, second, third, etc., cleat assemblies will be identified with a number of "prime" symbols in a manner similar to the whaler clamp assemblies 60. As shown in FIG. 3, each whaler cleat assembly 150 includes an elongated, generally planar body 152, a first whaler bracket 170, and a second whaler bracket 180. Each whaler cleat assembly body 152 includes a first end 154, a medial portion 156, and a second end 158. Each whaler cleat assembly body first end 154 includes an upwardly depending outer support 160 and an upwardly depending inner support 162. As used herein, "upwardly depending" means extending from, in a generally upward direction. Each whaler cleat assembly body second end 158 includes an upwardly depending outer support 164 and an upwardly depending inner support 166. The inner supports 162, 166 are spaced a distance corresponding to the thickness of the wall to be poured. Each associated set of inner and outer supports 160, 162 and 164, 166 are each spaced a distance corresponding, or snuggly corresponding, to the thickness of the panels 22. In this configuration, the pairs of supports 160, 162 and 164, 166 are structured to, and do, support a panel 22.

Each whaler cleat assembly first whaler bracket 170 is disposed at a whaler cleat assembly body first end 154. Each whaler cleat assembly second whaler bracket 180 is disposed at a whaler cleat assembly body second end 158. As before, a "whaler bracket" is sized and shaped to accommodate a whaler 480. In an embodiment wherein a whaler 480 is a 2-by-4, each whaler bracket 170, 180 is a U-shaped support. As shown, the outer supports 160, 164, in an exemplary embodiment, also define a portion of the cleat assembly whaler brackets 170, 180. Thus, in an exemplary embodiment, each whaler cleat assembly first whaler bracket 170 includes a generally planar, generally horizontal member 172 and a generally vertical member 174. Each whaler cleat assembly first whaler bracket horizontal member 172 includes a first end 176 and a second end 178. Each whaler cleat assembly first whaler bracket horizontal member first end 176 is coupled to the associated whaler cleat assembly body first end 154. Further, in an exemplary embodiment, each whaler cleat assembly first whaler bracket horizontal member 172 is disposed generally in the same plane as the associated whaler cleat assembly body 152. Similarly, each whaler cleat assembly second whaler bracket 180 includes a generally planar, generally horizontal member 182 and a generally vertical member 184. Each whaler cleat assembly second whaler bracket horizontal member 182 includes a first end 186 and a second end 188. Each whaler cleat assembly second whaler bracket horizontal member first end 186 is coupled to the associated whaler cleat assembly body second end 158. Further, in an exemplary embodiment, each whaler cleat assembly second whaler bracket horizontal member 182 is disposed generally in the same plane as the associated whaler cleat assembly body 152.

In another exemplary embodiment, not shown, the whaler cleat assembly 150 includes removably coupled cleat assembly whaler brackets 170, 180. That is, a whaler cleat assembly body 152 includes a first coupling component, such as, but not limited to, a coupling utilizing an opening in the whaler cleat assembly body first and/or second end 154, 158. Each whaler cleat assembly first and/or second whaler bracket 170, 180 includes a corresponding second coupling component, such as, but not limited to, a tab with an opening therein. Further, the first and/or second whaler bracket 170, 180, in an exemplary embodiment, defines a channel through which the whaler cleat assembly body first or second end 154, 158 extends.

Figure 4:
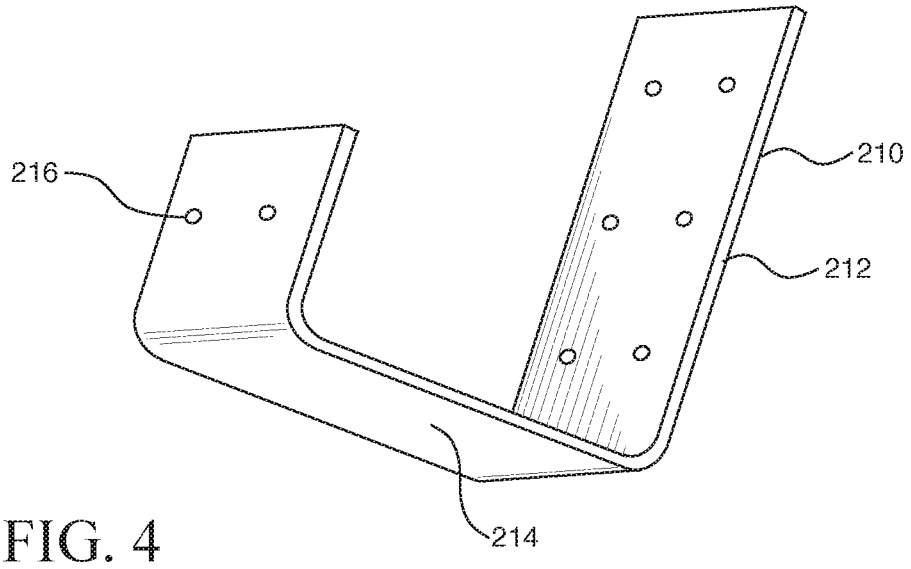
FIG. 4 is an isometric view of a stud bracket.
Figure 5:
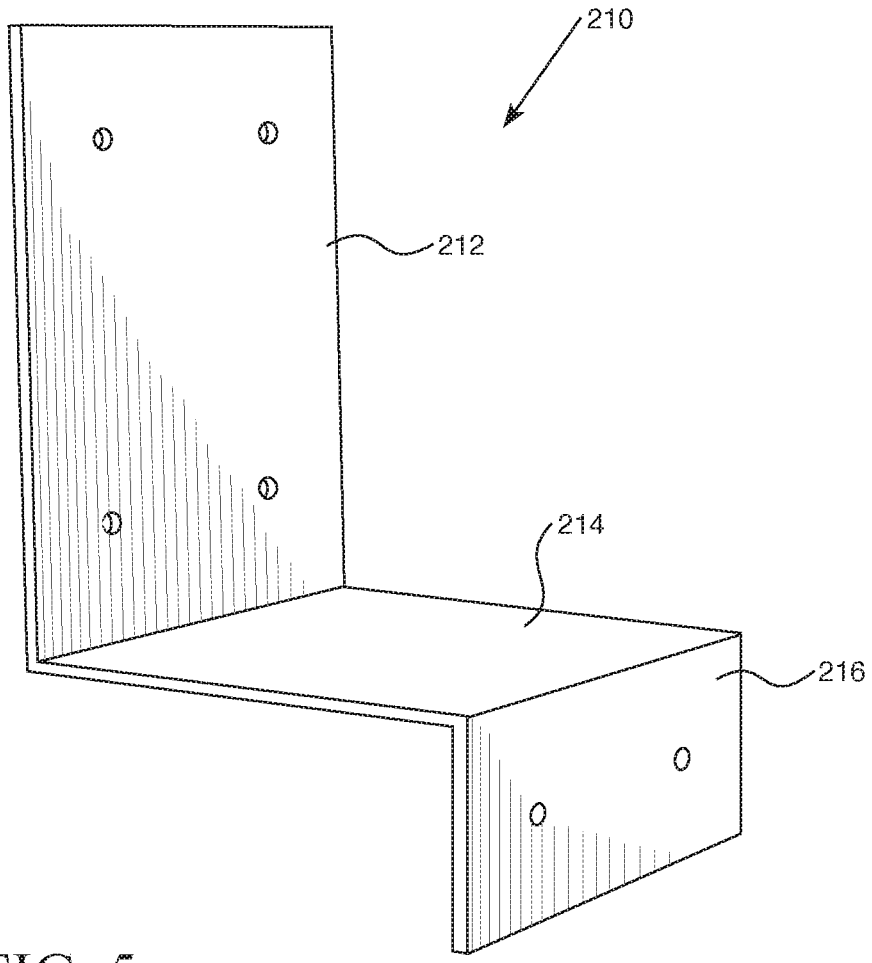
FIG. 5 is an isometric view of another embodiment of a stud bracket.
Figure 6:
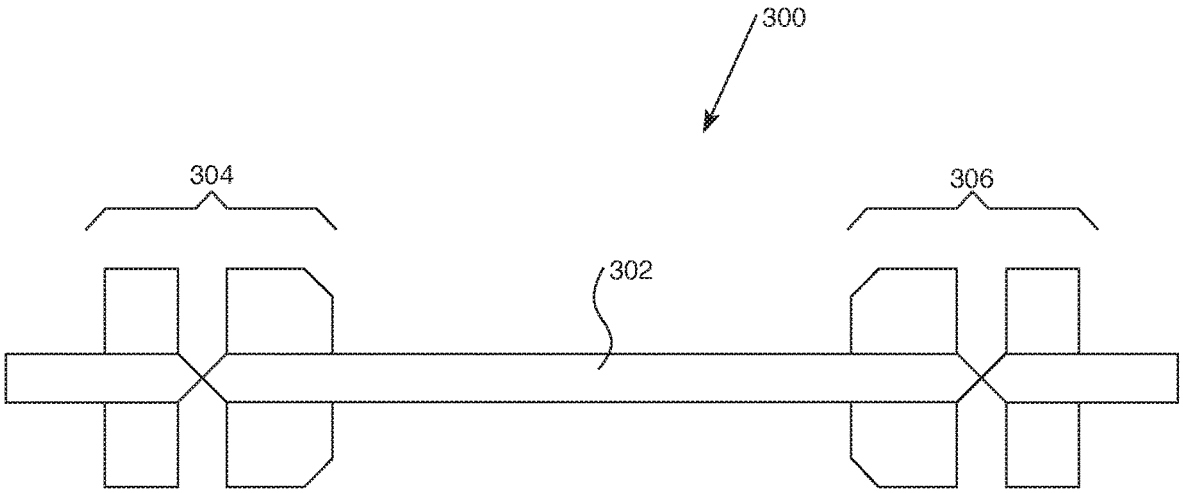
FIG. 6 is a schematic side view of a snap-tie.
Figure 7:
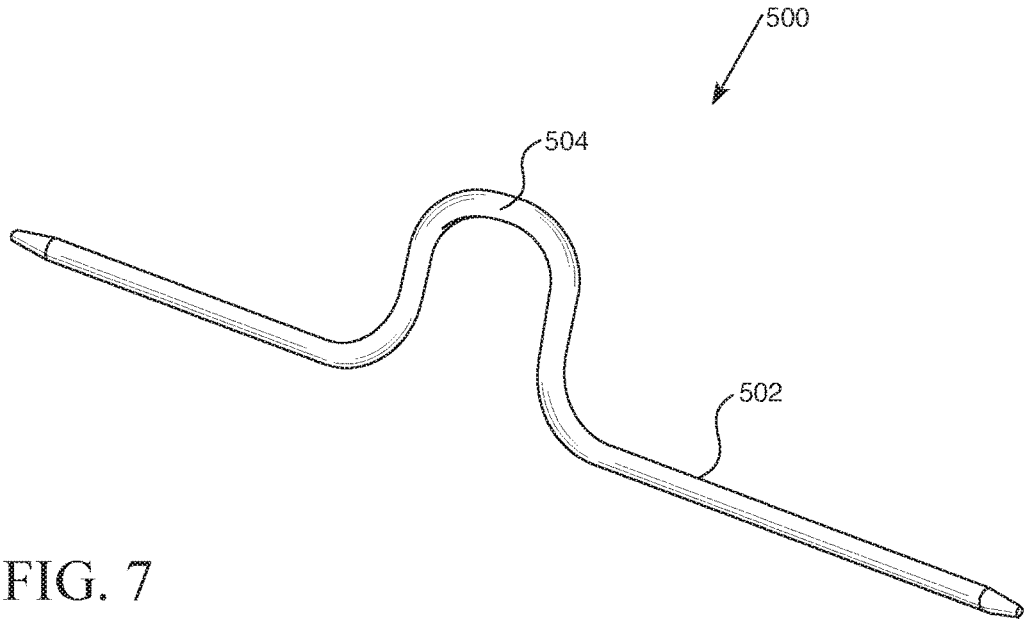
FIG. 7 is an isometric view of a centering assembly.

Further, in an exemplary embodiment, the retaining assembly 50 includes a number of upper stud brackets 200 and a number of lower stud brackets 202, as shown in FIGS. 4 and 5. The upper stud brackets 200 and the lower stud brackets 202 are substantially similar and the identifier "upper" and "lower" describe their position during use. Accordingly, only one stud bracket 210 is described. A stud bracket 210 is structured to be, and is, coupled to a whaler 480 and to support a stud 490. In an exemplary embodiment, each stud bracket 210 has a tabbed, L shaped cross-section. As used herein, a "tabbed, L-shaped cross-section" means a cross-section shaped like a capital letter "L" with an elongated, generally vertical portion 212, a generally horizontal portion 214, and a generally vertical tab 216 extending from the distal end of the generally horizontal portion 214. The tab extends either in the same direction, i.e. generally parallel and opposed to, the vertical portion 212 (FIG. 4), or, in the opposite direction, i.e. generally parallel to but not opposed to, the vertical portion 212 (FIG. 5) Further, as described below, when a whaler 480 is coupled to a whaler clamp assembly 60 and a whaler cleat assembly 150, the thickness of the whaler bracket offsets or spaces, the whaler 480 from the associated panel 22. Each stud bracket 210, i.e., the vertical portion of the L-shaped member, has a thickness that generally corresponds to the offset between the whaler 480 and the panel 22. Further, pairs of stud brackets 210 are structured to, and do, support a stud 490. A stud 490 is, in an exemplary embodiment, made from a wood 2-by-4. That is, each stud bracket 210 is coupled to a whaler 480. For example, the upper stud brackets 200 are inverted and coupled to a whaler 480. Each stud 490 extends between the whaler 480 coupled to the whaler clamp assemblies 60 and the whaler 480 coupled to the whaler cleat assemblies 150.

Further, in an exemplary embodiment, the retaining assembly 50 includes whalers 480 and studs 490. In an exemplary embodiment, the whalers 480 and studs 490 are made from a plastic or poly material and, as such, are reusable. This serves the problems noted above. In an exemplary embodiment, the whalers 480 and studs 490 are sized and shaped to correspond to wood 2-by-4s. Alternatively, the whalers 480 and studs 490 are wood 2-by 4s. It is understood that 2-by-4 is an exemplary dimension/cross-section and that the whalers 480 and studs 490 may be any size or shape.

Further, in an exemplary embodiment, the retaining assembly 50 includes a number of snap-ties 300. Snap-ties 300 are known and include an elongated rod 302 and braces 304, 306. That is, the braces 304, 306 are disposed at the ends of each rod 302 and are structured to be coupled to each side of a panel 22. Thus, the rod 302 has a length generally corresponding to the thickness of the wall being poured. Further, a rod 302 may also have a length sufficient to extend through a whaler 480 in addition to the spaced panels 22. As is known, when the concrete is set, the ends of the rod 302, as well as the braces 304, 306, are snapped off leaving the medial portion of the rod 302 in the set concrete.

The assembly of the concrete form assembly 10 uses fewer snap-ties 300 than the prior art because the snap-ties 300 are disposed only between the panels 22, or between the panels and along a panel vertical longitudinal axis 28; this solves the problems noted above. That is, assuming the four panels 22A, 22B, 22C, and 22D, discussed above, the first panel 22A and the second panel 22B are disposed generally in the same plane with the first panel vertical first edge 24A disposed immediately adjacent the second panel second vertical edge 24B. In this configuration, as shown in FIG. 1, the first panel vertical first edge 24A and the second panel second vertical edge 24B define a first snap tie line 400. Similarly, the third panel 22C and the fourth panel 22D are disposed generally in the same plane with the third panel vertical first edge 24C disposed immediately adjacent the fourth panel second vertical edge 26D. Thus, the third panel vertical first edge 22C and the fourth panel second vertical edge 26D define a second snap tie line 402. In this configuration, snap ties 300 are disposed only between the first snap tie line 400 and the second snap tie line 402. That is, snap-ties 300 are not disposed in drilled passages in the panels 22. As the passages 30 do not have to be drilled, the use of snap-ties 300 only between panels solves the problems noted above.

Alternatively, in an embodiment wherein the panels 22 have pre-formed passages 30, the passages 30 in the first panel form a first snap-tie line 450, the passages 30 in the second panel form a second snap-tie line 452, passages 30 in the third panel 22C form a third snap-tie line 454, and passages 30 in the fourth panel 22D form a fourth snap-tie line 456. Further, the panels 22 are assembled as described above and the first panel vertical first edge 24A and the second panel second vertical edge 24B define a fifth snap tie line 458, and, third panel vertical first edge 24C and the fourth panel second vertical edge 26D define a sixth snap tie line 460. In this embodiment, the snap ties 300 are disposed only between the first snap tie line 450 and the third snap tie line 454, between the second snap tie line 452 and the fourth snap tie line 456, and between the fifth snap tie line 458 and the sixth snap tie line 460. As before, passages do not have to be drilled and the use of snap-ties 300 only between panels 22 and along pre-formed passages 30 solves the problems noted above.

Further, in an exemplary embodiment, the retaining assembly 50 includes a number of centering assemblies 500. Each centering assembly 500 is structured to, and does, generally center rebar, or a portion of a rebar assembly, between opposed panels 22. In an exemplary embodiment, each centering assembly 500 includes an elongated, thin body 502, i.e., a rod, including a central curvilinear portion 504. The curvilinear portion 504 is sized to accommodate a cross-sectional area of rebar rod/wire. The centering assembly body 502, in one embodiment, is flexible and has a length slightly longer than the space between opposed panels 22. Thus, to use a centering assembly 500, the centering assembly 500 is positioned between two opposed panels with rebar disposed in the central curvilinear portion 504. Positioning the centering assembly 500, in an exemplary embodiment, includes flexing the centering assembly body 502. In this configuration, the centering assembly 500 engages the opposing panels 22. This solves the problems stated above.

The concrete form assembly 10 is assembled as shown in the Figures and as described below. That is, the whaler cleat assemblies 150 are disposed on a footer. The panels 22 are coupled to the whaler cleat assemblies 150 and disposed in an opposed relation. The snap-ties 300 are coupled to and extend between opposed panels 22, and the whaler clamp assemblies 60 are disposed in a spaced relation at the top of the panels 22.

Whalers 480 are disposed in the whaler brackets of both the whaler clamp assemblies 60 and the whaler cleat assemblies 150. Studs 490 are disposed between the whalers 480 and maintained in place by the stud brackets 200, 202. It is noted that for a short wall, stud brackets 200, 202 are, in an exemplary embodiment, used to support the panels 22 without studs 490. Further, the orientation of the stud brackets 200, 202 can be reversed depending upon whether studs are used. If one or more intermediate whalers 480, i.e., whalers 480 between the top and bottom whalers 480 in the whaler clamp assemblies 60 and the whaler cleat assemblies 150, then, in an exemplary embodiment, the studs 490 are disposed inwardly, i.e., closer to the panels 22, of the intermediate whalers 480. It is noted that because the whaler clamp assemblies 60 and the whaler cleat assemblies 150 position whalers 480 adjacent the top and bottom of the shaping assembly 20, and/or, because the stud brackets 200 are disposed at seams between adjacent panels 22, the concrete form assembly 10 uses a "reduced" number of whaler cleat assemblies 150. As used herein, a "reduced" number of cleat assemblies 150 means about 35%-50% fewer cleat assemblies 150 are used when compared to a concrete form assembly that does not utilize whaler clamp assemblies 60 and the whaler cleat assemblies 150. As using fewer cleat assemblies 150 reduces the amount of time required to assemble the concrete form assembly 10, using a "reduced" number of whaler cleat assemblies 150 solves the problem noted above.

Similarly, because the whaler clamp assemblies 60 and the whaler cleat assemblies 150 position whalers adjacent the top and bottom of the shaping assembly 20, and/or, because the stud brackets 210 are disposed at seams between adjacent panels 22, the concrete form assembly 10 uses a "reduced" number of snap-ties 300. As used herein, a "reduced" number of snap-ties 300 means about 33% fewer snap-ties are used when compared to a concrete form assembly that does not utilize whaler clamp assemblies 60 and the whaler cleat assemblies 150. As using fewer snap-ties 300 reduces the amount of time required to assemble the concrete form assembly 10, using a "reduced" number of snap-ties 300 solves the problem noted above.

The whaler clamp assemblies 60 and the whaler cleat assemblies 150 are structured to, and do, position the panels 22 in an opposed relationship. Further, each whaler clamp assembly 60 may be adjusted so that the distal ends of the tines 68, 70 move between a wide, first position and a narrow, second position. It is understood that each whaler clamp assembly 60 is further structured to, and does, "clamp" the associated panels. As used herein, "clamp" means to inwardly engage opposed panels 22.

Generally, using any one of selected elements described above, i.e., a panel 22 with pre-formed passages 30 or using a panel 22 wherein the snap-ties are only disposed along the edges, whaler clamp assemblies 60 or whaler cleat assemblies 150, as well as stud brackets 200 or centering assembly 500, allows a user to assemble the concrete form assembly 10 in a "reduced" amount of time. As used herein, a "reduced" amount of time to assemble a concrete form assembly 10 is a length of time less than an excessive amount of time. As used herein, an "excessive" amount of time means the amount of time required to assemble a forming system wherein the whalers are nailed to the panels. Assembling a concrete form assembly 10 in a "reduced" amount of time solves the problems noted above. Further, using all of the selected elements described above, a panel 22 with pre-formed passages 30 or using a panel 22 wherein the snap-ties are only disposed along the edges, whaler clamp assemblies 60 and whaler cleat assemblies 150, as well as one of, or both, stud brackets 200 and/or centering assembly 500, allows a user to assemble the concrete form assembly 10 in a "very reduced" amount of time. Assembling a concrete form assembly 10 in a "very reduced" amount of time solves the problems noted above.

Figure 8A:
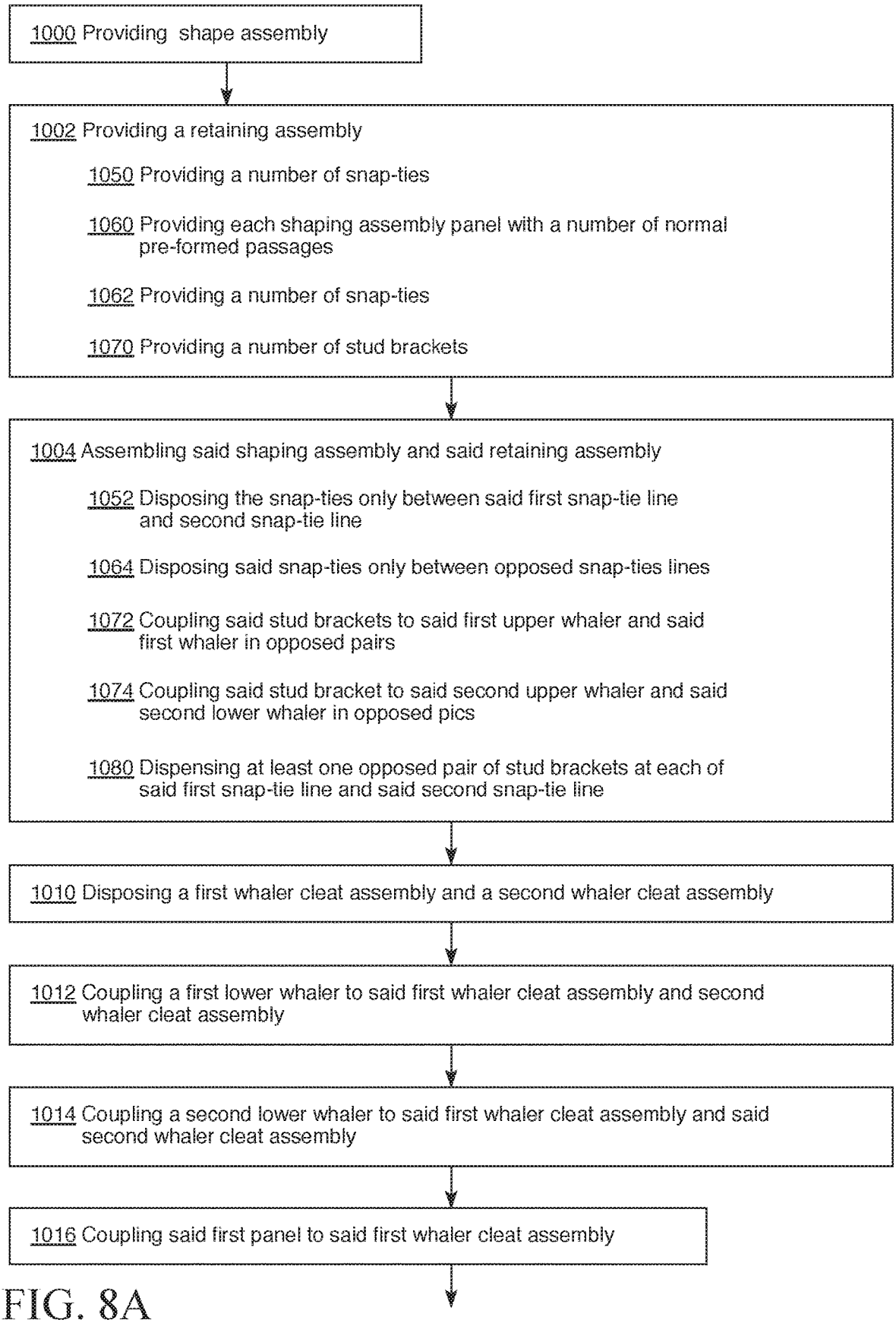
FIGS. 8A and 8B are a flowchart of the disclosed method. That is.
Figure 8B:
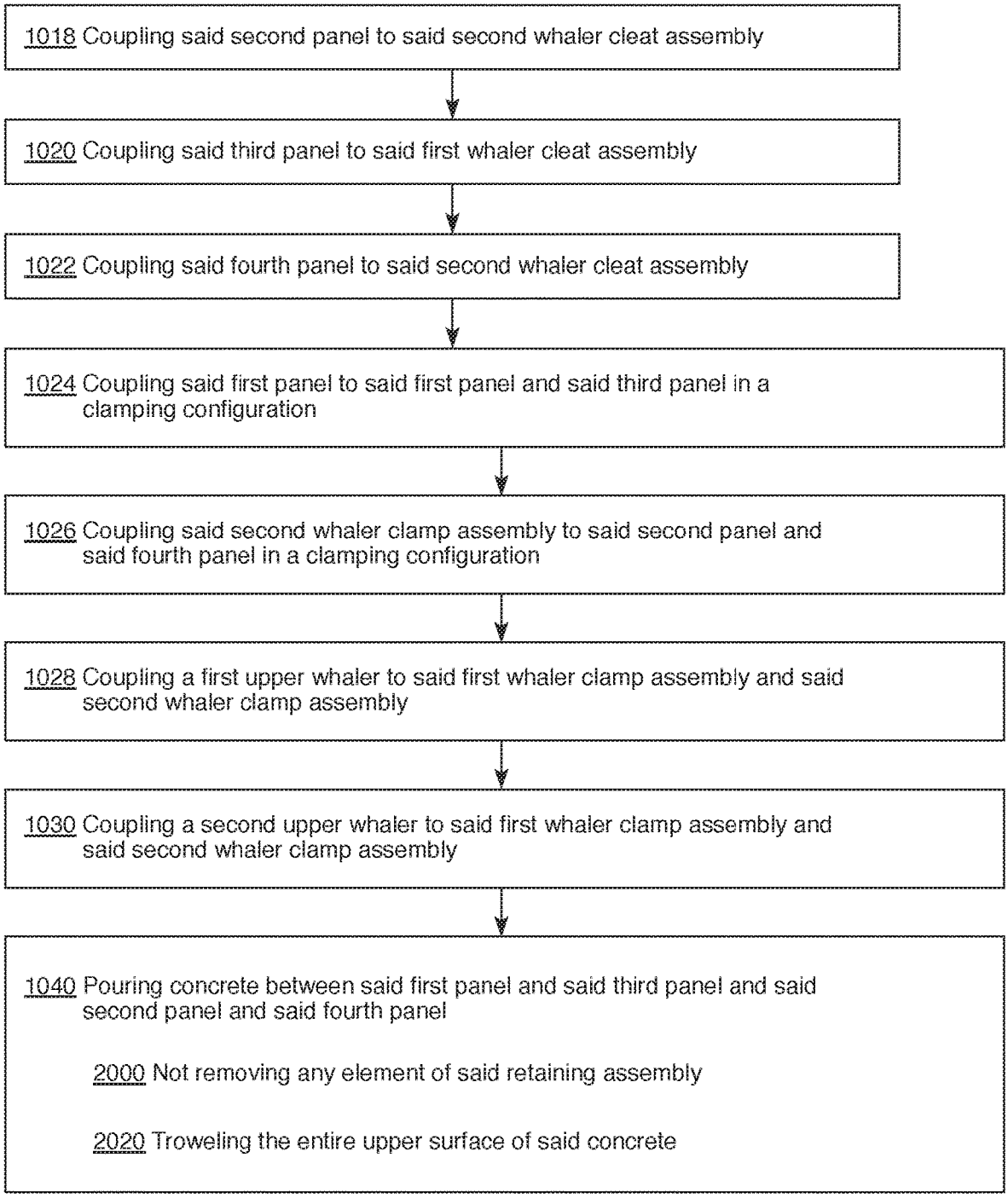

As shown in FIGS. 8A and 8B, a method of assembling a concrete form assembly includes: providing 1000 a shaping assembly including a number of generally planar panels, providing 1002 a retaining assembly including a number of whaler clamp assemblies, a number of whaler cleat assemblies, and a number of whalers, the number of whaler clamp assemblies includes a first whaler clamp assembly and a second whaler clamp assembly, the number of whaler cleat assemblies includes a first whaler cleat assembly and a second whaler cleat assembly, wherein each shaping assembly panel is generally rectangular having a first vertical edge, a second vertical edge, and a generally centered and generally vertical longitudinal axis, assembling 1004 the shaping assembly and the retaining assembly including: disposing 1010 a first whaler cleat assembly and a second whaler cleat assembly in a spaced and aligned formation, coupling 1012 a first lower whaler to the first whaler cleat assembly and the second whaler cleat assembly, coupling 1014 a second lower whaler to the first whaler cleat assembly and the second whaler cleat assembly, coupling 1016 the first panel to the first whaler cleat assembly, coupling 1018 the second panel to the second whaler cleat assembly, coupling 1020 the third panel to the first whaler cleat assembly, coupling 1022 the fourth panel to the second whaler cleat assembly, coupling 1024 the first whaler clamp assembly to the first panel and the third panel in a clamping configuration, coupling 1026 the second whaler clamp assembly to the second panel and the fourth panel in a clamping configuration, coupling 1028 a first upper whaler to the first whaler clamp assembly and the second whaler clamp assembly, coupling 1030 a second upper whaler to the first whaler clamp assembly and the second whaler clamp assembly, wherein the assembling the shaping assembly and a retaining assembly takes a reduced amount of time, and, pouring 1040 concrete between the first panel and the third panel, and, the second panel and the fourth panel. Further, in an exemplary embodiment, assembling 1004 the shaping assembly and the retaining assembly does not include creating passages 30 in the number of panels 22.

Further, in an exemplary embodiment, providing a retaining assembly 1002 and assembling the shaping assembly and the retaining assembly 1004 includes: providing 1050 a number of snap ties and disposing 1052 the snap ties only between the first snap tie line 400 and the second snap tie line 402.

Further, in an exemplary embodiment, providing 1000 a shaping assembly, providing a retaining assembly 1002 and assembling the shaping assembly and the retaining assembly 1004 includes: providing 1060 each shaping assembly panel with a number of normal pre-formed passages 30, each pre-formed passage 30 disposed along the panel longitudinal axis 28 and wherein the first panel pre-formed passages define a first snap tie line 450, the second panel pre-formed passages define a second snap tie line 452, the third panel pre-formed passages define a third snap tie line 454, the fourth panel pre-formed passages define a fourth snap tie line 456, providing 1062 a number of snap ties and disposing 1064 the snap ties only between opposed snap tie lines.

Further, in an exemplary embodiment, providing a retaining assembly 1002 and assembling the shaping assembly and the retaining assembly 1004 includes: providing 1070 a number of stud brackets, coupling 1072 the stud brackets to the first upper whaler and the first lower whaler in opposed pairs, and coupling 1074 the stud brackets to the second upper whaler and the second lower whaler in opposed pairs.

Further, in an exemplary embodiment, assembling the shaping assembly and the retaining assembly 1004 includes disposing 1080 at least one opposed pair of stud brackets at each of the first snap tie line and the second snap tie line.

Further, in an exemplary embodiment, pouring concrete includes: not removing 2000 any element of the retaining assembly, and, troweling 2002 the entire upper surface of the concrete; that is, the entire upper surface of the wall, i.e., the poured concrete, is accessible to a trowel.

Figure 9:
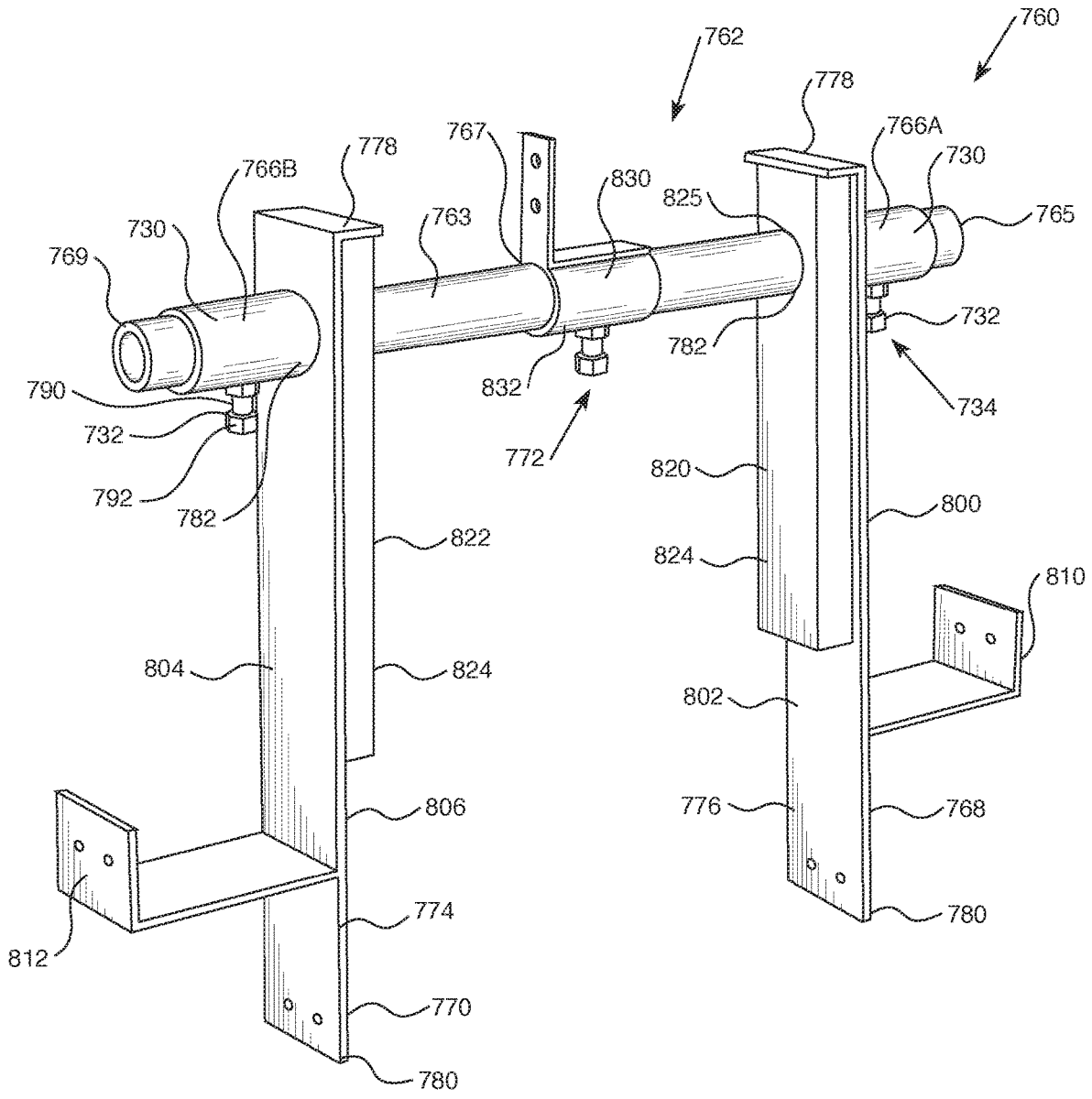
FIG. 9 is an isometric view of another embodiment of the concrete form assembly.

In another exemplary embodiment, shown in FIG. 9, the whaler clamp assemblies 760 include a U-shaped member 762 that is an assembly, hereinafter a "body assembly" 762. That is, as shown in FIG. 9, in this embodiment, each whaler clamp assembly 760 includes three bodies; a first tine 768, a second tine 770, a bight 772, as well as a first and second adjustable coupling assembly 766A, 766B. Each first and second adjustable coupling assembly 766A, 766B are also, as used herein, actuators, as discussed below.

As shown, the whaler clamp assembly bight 772 is, in an exemplary embodiment, a hollow, elongated, generally cylindrical body 763 having a first end 765, a medial portion 767 and a second end 769. Each tine 768, 770 includes a generally planar body 774, 776 respectively. Each tine planar body 774, 776 includes a first end 778 and a second end 780. Each tine planar body first end 778 defines a passage 782 sized and shaped to correspond, or snuggly correspond, to the cross-section of the whaler clamp assembly bight 772. That is, in the embodiment disclosed, each tine planar body first end passage 782 is a generally circular opening.

Further, and as before, each first tine body 774 includes an outer surface 800 and an inner surface 802. Each second tine body 776 includes an outer surface 804 and an inner surface 806. Each first tine body outer surface 800 includes a first whaler bracket 810, as defined above. Each second tine body outer surface 804 also includes a second whaler bracket 812. Further, each first tine body 774 inner surface 802 includes a first support lug 820. Each second tine body 776 inner surface 806 includes a second support lug 822. As shown, the two lugs 820, 822 are, in an exemplary embodiment, generally parallelepiped bodies 824 that are coupled, directly coupled, or fixed to the associated tine body inner surface 802, 806. As before, each lug 820, 822 is structured to, and does, rest on the upper surface of a panel 22. Further, each U-shaped member body first support lug 820 is spaced an effective distance from the associated U-shaped member body first whaler bracket 810. Each U-shaped member body second support lug 822 is also spaced an effective distance from the U-shaped member body second whaler bracket 812. Each lug 820, 822 also includes a passage 825 that is sized and shaped to correspond to, and is aligned with, the tine planar body first end passage 782.

Each first and second adjustable coupling assembly 766A, 766B includes a hollow, generally cylindrical body 730 and a locking device 732. Each adjustable coupling assembly body 730, i.e., the inner diameter thereof, is sized to correspond to the whaler clamp assembly bight body 763. In this configuration, each adjustable coupling assembly body 730 is structured to be, and is, disposed about the whaler clamp assembly bight body 763. In one embodiment, each adjustable coupling assembly body 730 is coupled, directly coupled, or fixed to a tine body outer surface 800. 804 and disposed at, and aligned with, the tine planar body first end passage 782.

Each coupling assembly locking device 732 is structured to, and does, temporarily fix the coupling assembly 766A, 766B to the whaler clamp assembly bight body 763. In the embodiment shown, each coupling assembly locking device 732 includes a threaded passage, as is known, extending radially through the adjustable coupling assembly body 730 and a threaded coupling 790 such as, but not limited to, a bolt 792. The adjustable coupling assembly threaded coupling 790 is threadably coupled to the adjustable coupling assembly locking device passage. It is understood that the adjustable coupling assembly threaded coupling 790 is moved inwardly to lock the associated first or second adjustable coupling assembly 766A, 766B to the whaler clamp assembly bight 772 and moved outwardly to release the first or second adjustable coupling assembly 766A, 766B from the whaler clamp assembly bight 772. In this configuration, each first and second adjustable coupling assembly 766A, 766B is structured to be, and is, selectably fixed to the whaler clamp assembly bight body 763 with the first tine 768 and the second tine 770 disposed in a clamping configuration.

In this embodiment, each whaler clamp assembly 760 is assembled as follows. The first tine 768 is movably coupled, and selectably locked, to the whaler clamp assembly bight body first end 765 (or medial portion 767) by passing the whaler clamp assembly bight body first end 765 through the first tine lug passage 825 and the first tine first end passage 782. The first tine 768 is oriented so that the first whaler bracket 810 extends away from the whaler clamp assembly bight body medial portion 767, i.e., outwardly. The first adjustable coupling assembly 766A is then disposed about the whaler clamp assembly bight body first end 765 and locked to the whaler clamp assembly bight body first end 765. That is, the whaler clamp assembly bight body first end 765 is passed through the first adjustable coupling assembly body 730 and the coupling assembly locking device threaded coupling 790 is tightened so as to fix the first adjustable coupling assembly body 730 to the whaler clamp assembly bight body first end 765 (or medial portion 767).

The second tine 770 is movably coupled, and selectably locked, to the whaler clamp assembly bight body second end 769 (or medial portion 767) by passing the whaler clamp assembly bight body second end 769 through the second tine lug passage 825 and the second tine first end passage 782. The second tine 770 is oriented so that the second whaler bracket 812 extends away from the whaler clamp assembly bight body medial portion 767, i.e., outwardly. The second adjustable coupling assembly 766B is then disposed about the whaler clamp assembly bight body second end 769 and locked to the whaler clamp assembly bight body second end 769. That is, the whaler clamp assembly bight body second end 769 is passed through the second adjustable coupling assembly body 730 and the coupling assembly locking device threaded coupling 790 is tightened so as to fix the second adjustable coupling assembly body 730 to the whaler clamp assembly bight body second end 769 (or medial portion 767). It is understood that the first and second adjustable coupling assemblies 766A, 766B are positioned so that the distance between the first and second tine planar bodies 774, 776 are spaced the desired distance apart, i.e., so that the first and second tine inner surfaces 802, 806 are spaced so as to contact the outer surfaces of the panels 22 to which the whaler clamp assembly 760 is coupled.

Further, in an exemplary embodiment, the whaler clamp assembly 760 also includes a center support 830. The whaler clamp assembly center support 830 is structured to, and does, support an L-shaped bracket 832. That is, a center support 830 includes a hollow, generally cylindrical body 730 and a locking device 732 that are substantially similar to the first and second adjustable coupling assemblies 766A, 766B described above (and therefor the same reference numbers are used). The center support 830 further includes a center L-shaped bracket 832 structured to support a support member such as, but not limited to a two by four, as described above. In use, the center support 830 is positioned over the center of the poured concrete. It is understood that, for thicker concrete formations, vertically extending rebar rods are disposed at about the center of the poured concrete. In use, a support member is disposed on the center support 830 and the vertically extending rebar rods are coupled thereto. This maintains the vertically extending rebar rods in a generally vertical orientation as the concrete hardens.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of assembling a concrete form comprising:

providing a shaping assembly including a number of generally planar panels;

providing a retaining assembly including a number of whaler clamp assemblies, a number of whaler cleat assemblies, and a number of whalers, said number of whaler clamp assemblies includes a first whaler clamp assembly and a second whaler clamp assembly, said number of whaler cleat assemblies includes a first whaler cleat assembly and a second whaler cleat assembly, wherein each shaping assembly panel is generally rectangular having a first vertical edge, a second vertical edge, and a generally centered and generally vertical longitudinal axis;

assembling said shaping assembly and said retaining assembly including:

disposing a first whaler cleat assembly and a second whaler cleat assembly in a spaced and aligned formation;

coupling a first lower whaler to said first whaler cleat assembly and said second whaler cleat assembly;

coupling a second lower whaler to said first whaler cleat assembly and said second whaler cleat assembly;

coupling a first panel of the number of generally planar panels to said first whaler cleat assembly;

coupling a second panel of the number of generally planar panels to said second whaler cleat assembly;

coupling a third panel of the number of generally planar panels to said first whaler cleat assembly;

coupling a fourth panel of the number of generally planar panels to said second whaler cleat assembly;

coupling said first whaler clamp assembly to said first panel and said third panel in a clamping configuration;

coupling said second whaler clamp assembly to said second panel and said fourth panel in a clamping configuration;

coupling a first upper whaler to said first whaler clamp assembly and said second whaler clamp assembly;

coupling a second upper whaler to said first whaler clamp assembly and said second whaler clamp assembly; and pouring concrete between said first panel and said third panel, and, said second panel and said fourth panel;

wherein said first panel and said second panel are disposed generally in the same plane with said first panel vertical first edge disposed immediately adjacent said second panel second vertical edge and wherein said first panel vertical first edge and said second panel second vertical edge define a first snap tie line, and wherein said third panel and said fourth panel disposed generally in the same plane with said third panel vertical first edge disposed immediately adjacent said fourth panel second vertical edge and wherein said third panel vertical first edge and said fourth panel second vertical edge define a second snap tie line, and wherein providing a retaining assembly and assembling said shaping assembly and said retaining assembly includes:

providing a number of snap ties; and disposing said snap ties only between said first snap tie line and said second snap tie line.

2. The method of claim 1 wherein said first panel and said second panel are disposed generally in the same plane with said first panel vertical first edge disposed immediately adjacent said second panel second vertical edge and wherein said first panel vertical first edge and said second panel second vertical edge define a fifth snap tie line, and wherein said third panel and said fourth panel disposed generally in the same plane with said third panel vertical first edge disposed immediately adjacent said fourth panel second vertical edge and wherein said third panel vertical first edge and said fourth panel second vertical edge define a sixth snap tie line, and wherein providing a shaping assembly, providing a retaining assembly and assembling said shaping assembly and said retaining assembly includes:

providing each shaping assembly panel with a number of normal pro-formed passages, each pre-formed passage disposed along said panel longitudinal axis and wherein said first panel pro-formed passages define a first snap tie line, said second panel pre-formed passages define a second snap tie line, said third panel pre-formed passages define a third snap tie line, said fourth panel pre-formed passages define a fourth snap tie line;

providing a number of snap ties; and disposing said snap ties only between opposed snap tie lines.

3. The method of claim 1 wherein providing a retaining assembly and assembling said shaping assembly and said retaining assembly includes:

providing a number of stud brackets;

coupling said stud brackets to said first upper whaler and said first lower whaler in opposed pairs; and coupling said stud brackets to said second upper whaler and said second lower whaler in opposed pairs.

4. The method of claim 3 wherein said first panel and said second panel are disposed generally in the same plane with said first panel vertical first edge disposed immediately adjacent said second panel second vertical edge and wherein said first panel vertical first edge and said second panel second vertical edge define a first snap tie line, and wherein said third panel and said fourth panel disposed generally in the same plane with said third panel vertical first edge disposed immediately adjacent said fourth panel second vertical edge and wherein said third panel vertical first edge and said fourth panel second vertical edge define a second snap tie line, and wherein assembling said shaping assembly and said retaining assembly includes:

disposing at least one opposed pair of stud brackets at each of said first snap tie line and said second snap tie line.

5. The method of claim 1 wherein pouring concrete includes:

not removing any element of said retaining assembly; and troweling the entire upper surface of said concrete.

6. A concrete form assembly comprising:

a shaping assembly including a number of generally planar panels; and a retaining assembly including a number of whaler clamp assemblies and a number of whaler cleat assemblies;

wherein each said whaler clamp assembly includes a body assembly;

wherein each said whaler clamp assembly body assembly includes a bight, a first tine and a second tine, a first adjustable coupling assembly, and a second adjustable coupling assembly;

said bight including an elongated body with a first end, a medial portion and a second end;

said first tine including a generally planar body with a first end and a second end;

said first tine coupled to said bight first end;

said second tine coupled to said bight second end;

said first adjustable coupling assembly coupled to said bight first end; and said second adjustable coupling assembly coupled to said bight second end.

7. The concrete form assembly of claim 6 wherein:

said first adjustable coupling assembly includes a body and a locking device;

said second adjustable coupling assembly includes a body and a locking device;

said first adjustable coupling body is hollow and sized to correspond to said bight;

said second adjustable coupling body is hollow and sized to correspond to said bight;

said first adjustable coupling assembly is structured to be fixed to said bight with said first tine in a clamping configuration; and said second adjustable coupling assembly is structured to be fixed to said bight with said second tine in a clamping configuration.

8. The concrete form assembly of claim 6 wherein:
said first tine includes an outer surface and an inner surface;
said second tine includes an outer surface and an inner surface;
said first tine outer surface includes a whaler bracket;
said second tine outer surface includes a whaler bracket;
said first tine inner surface includes a first support lug;
said first support lug spaced an effective distance from said first whaler bracket; and
said second tine inner surface includes a second support lug, said second support lug spaced an effective distance from said second whaler bracket.

9. A concrete form assembly comprising:
a shaping assembly including a number of generally planar panels; and
a retaining assembly including a number of whaler clamp assemblies and a number of whaler cleat assemblies;
wherein each whaler cleat assembly includes an elongated, generally planar body, a first whaler bracket, and a second whaler bracket;
said whaler cleat assembly body including a first end, a medial portion, and a second end;
each whaler cleat assembly body first end including an upwardly depending outer support and an upwardly depending inner support;
each whaler cleat assembly body second end including an upwardly depending outer support and an upwardly depending inner support;
each whaler cleat assembly first whaler bracket disposed at said whaler cleat assembly body first end; and
each whaler cleat assembly second whaler bracket disposed at said whaler cleat assembly body second end.

10. The concrete form assembly of claim 9 wherein each said whaler clamp assembly includes a body assembly.

11. The concrete form assembly of claim 9 wherein:
each whaler cleat assembly first whaler bracket includes a generally planar horizontal member and a generally vertical member;
each whaler cleat assembly first whaler bracket horizontal member includes a first end and a second end;
each said whaler cleat assembly first whaler bracket horizontal member first end coupled to said whaler cleat assembly body first end;
each whaler cleat assembly second whaler bracket includes a generally planar horizontal member and a generally vertical member;
each whaler cleat assembly second whaler bracket horizontal member includes a first end and a second end; and
each said whaler cleat assembly second whaler bracket horizontal member first end coupled to said whaler cleat assembly body second end.

12. A concrete form assembly comprising:
a shaping assembly including a number of generally planar panels; and
a retaining assembly including a number of whaler clamp assemblies and a number of whaler cleat assemblies;
wherein said number of whaler clamp assemblies includes a first whaler clamp assembly and a second whaler clamp assembly;
said first whaler clamp assembly and said second whaler clamp assembly disposed is a generally horizontal spaced relation;
said number of whaler cleat assemblies includes a first whaler cleat assembly and a second whaler cleat assembly;
said first whaler cleat assembly and said second whaler cleat assembly disposed in a generally horizontal spaced relation;
said retaining assembly includes a number of upper stud brackets, a number of lower stud brackets, a first whaler, a second whaler, and number of studs;
said first whaler coupled to, and disposed between said first whaler clamp assembly and said second whaler clamp assembly;
said second whaler coupled to, and disposed between said first whaler cleat assembly and a second whaler cleat assembly;
said first whaler disposed generally vertically above said second whaler;
said number of upper stud brackets includes a first upper stud bracket;
said first upper stud bracket coupled to said first whaler;
said number of lower stud brackets includes a first lower stud bracket;
said first lower stud bracket coupled to said second whaler,
said first upper stud bracket disposed generally, vertically above said first lower stud bracket; and
said first stud coupled to, and extending between, said first upper stud bracket and said first lower stud bracket.

13. The concrete form assembly of claim 12 wherein:
each upper stud bracket has a tabbed-L shaped cross-section; and
each lower stud bracket has a tabbed-L shaped cross-section.

14. The concrete form assembly of claim 12 wherein:
said retaining assembly includes a number of snap-ties;
said shaping assembly panels are generally rectangular having a first vertical edge and a second vertical edge;
said shaping assembly number of panels includes a first panel, a second panel, a third panel and a fourth panel;
said first panel and said second panel disposed generally in the same plane with said first panel vertical first edge disposed immediately adjacent said second panel second vertical edge wherein said first panel vertical first edge and said second panel second vertical edge define a first snap tie line;
said third panel and said fourth panel disposed generally in the same plane with said third panel vertical first edge disposed immediately adjacent said fourth panel second vertical edge wherein said third panel vertical first edge and said fourth panel second vertical edge define a second snap tie line;
said first and second panels disposed in a spaced and opposed relation to said third and fourth panels; and
said snap ties disposed only between said first snap tie line and said second snap tie line.

15. The concrete form assembly of claim 12 wherein:
said retaining assembly includes a number of snap-ties;
each shaping assembly panel is generally rectangular having a first vertical edge, a second vertical edge, and a generally centered and generally vertical longitudinal axis;
each shaping assembly panel including a number of normal pre-formed passages, each pre-formed passage disposed along said panel longitudinal axis;
said shaping assembly number of panels includes a first panel, a second panel, a third panel and a fourth panel;
said first panel pre-formed passages defining a first snap tie line;
said second panel pre-formed passages defining a second snap tie line;

said third panel pre-formed passages defining a third snap tie line;

said fourth panel pre-formed passages defining a fourth snap tie line;

said first panel and said second panel disposed generally in the same plane with said first panel vertical first edge disposed immediately adjacent said second panel second vertical edge wherein said first panel vertical first edge and said second panel second vertical edge define a fifth snap tie line;

said third panel and said fourth panel disposed generally in the same plane with said third panel vertical first edge disposed immediately adjacent said fourth panel second vertical edge wherein said third panel vertical first edge and said fourth panel second vertical edge define a sixth snap tie line;

said first and second panels disposed in a spaced and opposed relation to said third and fourth panels;

wherein said first snap tie line is generally opposed to said third snap tie line;

wherein said second snap tie line is generally opposed to said fourth snap tie line;

wherein said fifth snap tie line is generally opposed to said sixth snap tie line; and said snap ties disposed only between generally opposed snap tie lines.

* * * * *